US010008376B2

(12) United States Patent
Bloomfield et al.

(10) Patent No.: US 10,008,376 B2
(45) Date of Patent: Jun. 26, 2018

(54) METHODS AND SYSTEMS FOR SELECTING IONS FOR ION FRAGMENTATION

(71) Applicant: DH Technologies Development PTE Ltd., Singapore (SG)

(72) Inventors: Nic Bloomfield, Newmarket (CA); Stephen A. Tate, Barrie (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days. days.

(21) Appl. No.: 15/522,240

(22) PCT Filed: Oct. 27, 2015

(86) PCT No.: PCT/IB2015/058287

§ 371 (c)(1),
(2) Date: Apr. 26, 2017

(87) PCT Pub. No.: WO2016/067204

PCT Pub. Date: May 6, 2016

(65) Prior Publication Data

US 2017/0338091 A1 Nov. 23, 2017

Related U.S. Application Data

(60) Provisional application No. 62/072,930, filed on Oct. 30, 2014.

(51) Int. Cl.
*H01J 49/00* (2006.01)
*H01J 49/10* (2006.01)

(52) U.S. Cl.
CPC ..... *H01J 49/10* (2013.01); *H01J 49/0031* (2013.01); *H01J 49/004* (2013.01)

(58) Field of Classification Search
CPC ..... H01J 49/10; H01J 49/0031; H01J 49/004
USPC ..... 250/281, 282
See application file for complete search history.

(56) References Cited

U.S. PATENT DOCUMENTS 5,300,771 A * 4/1994 Labowsky ..... H01J 49/0027 250/282
2006/0243900 A1 11/2006 Overney et al.
2010/0288918 A1 11/2010 Satulovsky
2011/0192971 A1 8/2011 Yamaguchi
2013/0206977 A1* 8/2013 Yoo ..... G06F 19/703 250/282

(Continued)

FOREIGN PATENT DOCUMENTS

JP 2006064562 A 3/2006
JP 2013015485 A 1/2013

OTHER PUBLICATIONS

International Search Report and Written Opinion for PCT/IB2015/058287 dated Mar. 31, 2016.

*Primary Examiner* — Michael Maskell

(57) ABSTRACT

The present teachings are directed to methods and systems for the selection of ions for subsequent ion fragmentation in the analysis of a sample. Rather than select the most intense subset of precursor ions for further analysis in an attempt to maximize the number of high quality, identifiable MS/MS spectra, in some settings, systems and methods for analyzing and 5 identifying precursor ions for further processing can benefit from a discovery approach in which precursor ions are selected randomly/stochastically.

20 Claims, 4 Drawing Sheets

(56) References Cited

U.S. PATENT DOCUMENTS

2015/0129758 A1* 5/2015 Bonner ..... H01J 49/0036
250/282

* cited by examiner

METHODS AND SYSTEMS FOR SELECTING IONS FOR ION FRAGMENTATION

RELATED APPLICATIONS

This application claims the benefit of priority from U.S. Provisional Application Ser. No. 62/072,930 filed on Oct. 30, 2014, the entire contents of which is hereby incorporated by reference.

FIELD

The present teachings generally relate to the field of mass spectrometry.

BACKGROUND

The analysis of a substance to determine its composition may be necessary for many applications, including toxicology, forensics and environmental testing, as well as food and drug research. Often, samples to be analyzed are analyzed for the presence of numerous different analytes of interest. Such samples may, for example, be in the form of bodily fluids taken from test subjects, which fluids often include both drug metabolites of interest, as well as irrelevant endogenous ions from the test subject. Correctly determining the presence or absence of a large number of analytes of interest from complex substances can be difficult and time-consuming.

Mass spectrometers are often used for producing a mass spectrum of a sample to find its composition. For example, chromatographic equipment such as a liquid chromatograph is frequently used to elute ions from a sample into the mass spectrometer over a period of time and recursive MS techniques can be utilized to identify the structure of various analytes contained within portions of the eluted sample.

In most instruments with MS/MS capabilities, the process of generating a mass spectrum, selecting a precursor ion and generating an MS/MS spectrum of product ions can be performed in an automated mode. Current automated protocols in tandem mass spectrometry generally perform a single MS of a sample (e.g., a survey scan) to identify candidates within the sample for further processing, and select among all species observed a subset of precursor ions for analysis by MS/MS. This is normally achieved by ionizing the sample and separating ions of differing masses and recording their relative abundance by measuring intensities of ion flux in a survey scan. For example, with time-of-flight mass spectrometers, ions are pulsed to travel a predetermined flight path. The ions are then subsequently recorded by a detector. The amount of time that the ions take to reach the detector, the "time-of-flight," may be used to calculate the ion's mass to charge ratio, m/z. Additional information can then be obtained by fragmenting the selected precursor ion(s) via CID (collision induced dissociation) in a collision cell (or other means) to generate an MS/MS spectrum.

In selecting the precursor ions for further processing, current automated protocols generally focus on the most abundant precursor ions within the eluted sample, as determined by their detected intensity in the survey scan so as to maximize the number of high quality, identifiable MS/MS spectra. That is, both the precursor ions selected for further processing and the parameters used during MS/MS are generally selected to maximize the chances of being able to identify the structure of various precursor ions (and their constituents). By way of example, the most-intense 20 precursor ions detected via the survey scan are ranked based on their intensity and serially processed from most-intense to least-intense in one or more downstream product ion stages. Examples of this mode of acquisition include Information Dependent Acquisition (IDA) or Data Dependent Acquisition (DDA).

SUMMARY

The present teachings provide for the selection of ions for subsequent ion fragmentation in the analysis of a sample. As noted above, current automated protocols in MS/MS generally perform a single survey scan of a sample, and select among all species observed a subset of compound ions (sometimes referred to as precursor ions) for further analysis in an attempt to maximize the number of high quality, identifiable MS/MS spectra. Applicant has determined, however, that such an approach biased toward the most abundant species in a sample (or the most easily ionized species), may in turn decrease the possible scope in coverage or sensitivity of these automated techniques. For example, while an abundant protein whose peptides ionize well may generate several precursor ions that display high intensities by MS, analysis of these species will consume instrument time that could instead be devoted to inspecting ions of lower intensity that belong to different, overlooked analytes within the co-eluted sample. The applicant has recognized that in some settings, systems and methods for analyzing and identifying precursor ions for further processing can benefit from an alternative discovery approach.

Thus, whereas current protocols generally focus on the relative intensities of precursor ions as detected in a survey scan, methods and systems in accordance with various aspects of the present teachings remove the conventional bias toward the most abundant ions in selecting ions for further processing. In accordance with various aspects of the present teachings, a method of analyzing a sample is provided comprising: (a) performing a mass spectrometry survey scan on ions from a sample to acquire a compound ion spectrum, the precursor ion spectrum exhibiting a plurality of peaks, each of which corresponds to a plurality of ions having an indicated m/z ratio; (b) selecting a first peak of the survey scan corresponding to a first plurality of compound ions for further processing; (c) performing mass spectrometry on said first plurality of compound ions corresponding to the first peak so as to acquire a first product ion spectrum; (d) selecting a second peak of the survey scan corresponding to a second plurality of compound ions for further processing; and (e) performing mass spectrometry on said second plurality of compound ions corresponding to the second peak so as to acquire a second product ion spectrum, wherein at least one of the first and the second peak of the survey scan are selected randomly.

In accordance with various aspects of the present teachings, a method of analyzing a sample is provided that comprises: (a) performing a mass spectrometry survey scan on ions from a sample to acquire a precursor ion spectrum, the precursor ion spectrum exhibiting a plurality of peaks, each of which corresponds to a plurality of ions having an indicated m/z ratio; (b) selecting precursor ions corresponding to a first peak of the survey scan for further processing; (c) performing mass spectrometry on the precursor ions corresponding to the first peak so as to acquire a first product ion spectrum; (d) selecting precursor ions corresponding to a second peak of the survey scan for further processing; and thereafter (e) performing mass spectrometry on said precursor ions corresponding to the second peak so as to acquire a second product ion spectrum, wherein the second peak of the survey scan can exhibit a higher intensity relative to the first peak in the survey scan. In some aspects, the method can further comprise repeating steps (d)-(e) N times so as to subsequently select precursor ions corresponding to N peaks for further processing and performing mass spectrometry on said selected precursor ions to acquire N product ion spectra, wherein selection of the precursor ions corresponding to the N peaks is not based on the relative intensities of the peaks in the survey scan. In some aspects, for example, the first and second precursor ions can be selected stochastically or randomly from a plurality of candidate peaks of the precursor ion spectrum.

Candidate peaks can be identified in a plurality of manners and one or more filters can be applied to identify these candidate peaks. For example, in some aspects, candidate peaks can be identified from the precursor ion spectrum based on a threshold intensity of the peaks in the precursor ion spectrum. Alternatively or additionally, candidate peaks can be identified from the precursor ion spectrum based on a selected charge state (e.g., to identify precursor ions exhibiting a charge state≥2). Likewise, candidate peaks can be identified from the precursor ion spectrum based on being outside an exclusion window and/or based on correspondence to one or more species of interest identified in an inclusion list. For example, the inclusion list can be a user-defined list that comprises a m/z range of interest or one or more selected multiple reaction monitoring (MRM) transitions. Though the selection of ions for further processing can be performed stochastically, the selection can also be weighted based on empirical data if a priori knowledge of a desired candidate(s). For example, in selecting ions for further processing, the method can assign peaks corresponding to selected m/z ratios (e.g., as listed in an inclusion list) a higher weighting or priority relative to candidate peaks identified in the survey scan corresponding to m/z ratios absent from the inclusion list.

In accordance with various aspects of the present teachings, selecting precursor ions corresponding to the first and second peaks of the survey scan for further processing can further comprise providing an inclusion list of peptides of interest, the inclusion list comprising for each peptide of interest at least one of a predicted retention time for the peptide, at least one protein of interest to which the peptide belongs, and a sequence of the peptide. The mass of the precursor ions corresponding to the peaks of the survey scan can be compared to a mass of the peptides in the inclusion list so as to assign a higher priority or weight to its selection.

In various aspects, the methods described herein can also be applied to downstream processing of ions (e.g., in product ion analysis in MS' techniques). For example, the method can further comprise performing mass spectrometry on product ions corresponding to one or more peaks of the first product ion spectrum. In some aspects, the method can comprise: (c)(1) selecting a first peak of the first product ion spectrum corresponding to a first plurality of product ions for further processing; (c)(2) performing mass spectrometry on said first plurality of product ions corresponding to the first peak of the first product ion spectrum so as to acquire a first second-generation ion product spectrum; (c)(3) selecting a second peak of the first product ion spectrum corresponding to a second plurality of product ions for further processing; and thereafter (c)(4) performing mass spectrometry on said second plurality of product ions corresponding to the second peak of the first product ion spectrum so as to acquire a second second-generation ion product spectrum, wherein at least one of the first and the second peak of the survey scan are selected randomly.

In accordance with various aspects of the present teachings, computer readable media configured to cause a mass spectrometer having a computer controller to perform the methods described herein can also be provided.

In accordance with various aspects of the present teachings, a mass spectrometry system is provided that comprises a mass spectrometer and a controller operatively coupled to the mass spectrometer for controlling operation thereof. By way of example, the controller can include a processor configured to control the mass spectrometer so as to: (a) perform a mass spectrometry survey scan on ions from a sample to acquire a precursor ion spectrum, the precursor ion spectrum exhibiting a plurality of peaks, each of which corresponds to a plurality of ions having an indicated m/z ratio; (b) select precursor ions corresponding to a first peak of the survey scan for further processing; (c) perform mass spectrometry on the precursor ions corresponding to the first peak so as to acquire a first product ion spectrum; (d) select precursor ions corresponding to a second peak of the survey scan for further processing; and thereafter (e) perform mass spectrometry on said precursor ions corresponding to the second peak so as to acquire a second product ion spectrum, wherein the second peak of the survey scan exhibits a higher intensity relative to the first peak in the survey scan.

In some aspects, the controller can be configured to provide an inclusion list in response to data supplied by a user of the system. By way of example, the controller can be configured to select for further processing precursor ions corresponding to candidate peaks representing m/z ratios identified in the inclusion list. Though precursor ions selected for further processing can be determined stochastically, the controller can be configured to assign priority or weight the candidate peaks based in part on being on the inclusion list.

In accordance with various aspects of the present teachings, a method of analyzing a sample is provided that comprises: (a) performing a mass spectrometry survey scan on ions from a sample to acquire a compound ion spectrum, the compound ion spectrum exhibiting a plurality of peaks, each of which corresponds to a plurality of ions having an indicated m/z ratio; (b) selecting a first peak of the survey scan corresponding to a first plurality of compound ions for further processing; (c) performing mass spectrometry on said first plurality of compound ions corresponding to the first peak so as to acquire a first product ion spectrum; (d) selecting a second peak of the survey scan corresponding to a second plurality of compound ions for further processing; and (e) performing mass spectrometry on said second plurality of compound ions corresponding to the second peak so as to acquire a second product ion spectrum, wherein the step of selecting the second peak is not based on relative intensities of the first peak and the second peak in the survey scan.

In accordance with various aspects of the present teachings, a method of analyzing a sample is provided that comprises: (a) performing a mass spectrometry survey scan on ions from a sample to acquire a compound ion spectrum, the compound ion spectrum exhibiting a plurality of peaks, each of which corresponds to a plurality of ions having an indicated m/z ratio; (b) performing mass spectrometry on a first plurality of compound ions corresponding to the first peak so as to acquire a first product ion spectrum; and thereafter (c) performing mass spectrometry on a second plurality of compound ions corresponding to a second peak so as to acquire a second product ion spectrum, wherein the second peak of the survey scan can exhibit a higher intensity relative to the first peak in the survey scan.

These and other features of the applicant's teachings are set forth herein.

BRIEF DESCRIPTION OF THE DRAWINGS

The foregoing and other objects and advantages of the invention will be appreciated more fully from the following further description, with reference to the accompanying drawings. The skilled person in the art will understand that the drawings, described below, are for illustration purposes only. The drawings are not intended to limit the scope of the applicant's teachings in any way.

DETAILED DESCRIPTION

It will be appreciated that for clarity, the following discussion will explicate various aspects of embodiments of the applicant's teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicant's teachings may not require certain of the specifically described details in every implementation, which are set forth herein only to provide a thorough understanding of the embodiments. Similarly it will be apparent that the described embodiments may be susceptible to alteration or variation according to common general knowledge without departing from the scope of the disclosure. The following detailed description of embodiments is not to be regarded as limiting the scope of the applicant's teachings in any manner.

Methods and systems for selecting ions from a survey scan for further processing are provided herein. Whereas current automated protocols in MS/MS generally select from a survey scan a subset of high-intensity precursor ions that maximize the number of high quality, identifiable MS/MS spectra and process these precursor ions serially based on their detected intensity in the survey scan (e.g., most-intense to least-intense for a selected number of the most-intense precursor ions), methods and systems in accordance with various aspects of the present teachings remove the bias toward the most-intense ions, thereby increasing the possible scope in coverage or sensitivity of these automated techniques. For example, whereas conventional techniques for IDA or DDA prioritize the precursor ions having the highest intensity, the methods and systems described herein enable an increased breadth of analysis by using a more stochastic or random selection of precursor ions. In some aspects, such a selection may enable analysis of precursor ions exhibiting lower intensity in the survey scan such that these overlooked analytes within the co-eluted sample are alternatively or additionally analyzed in downstream processing.

Figure 1:
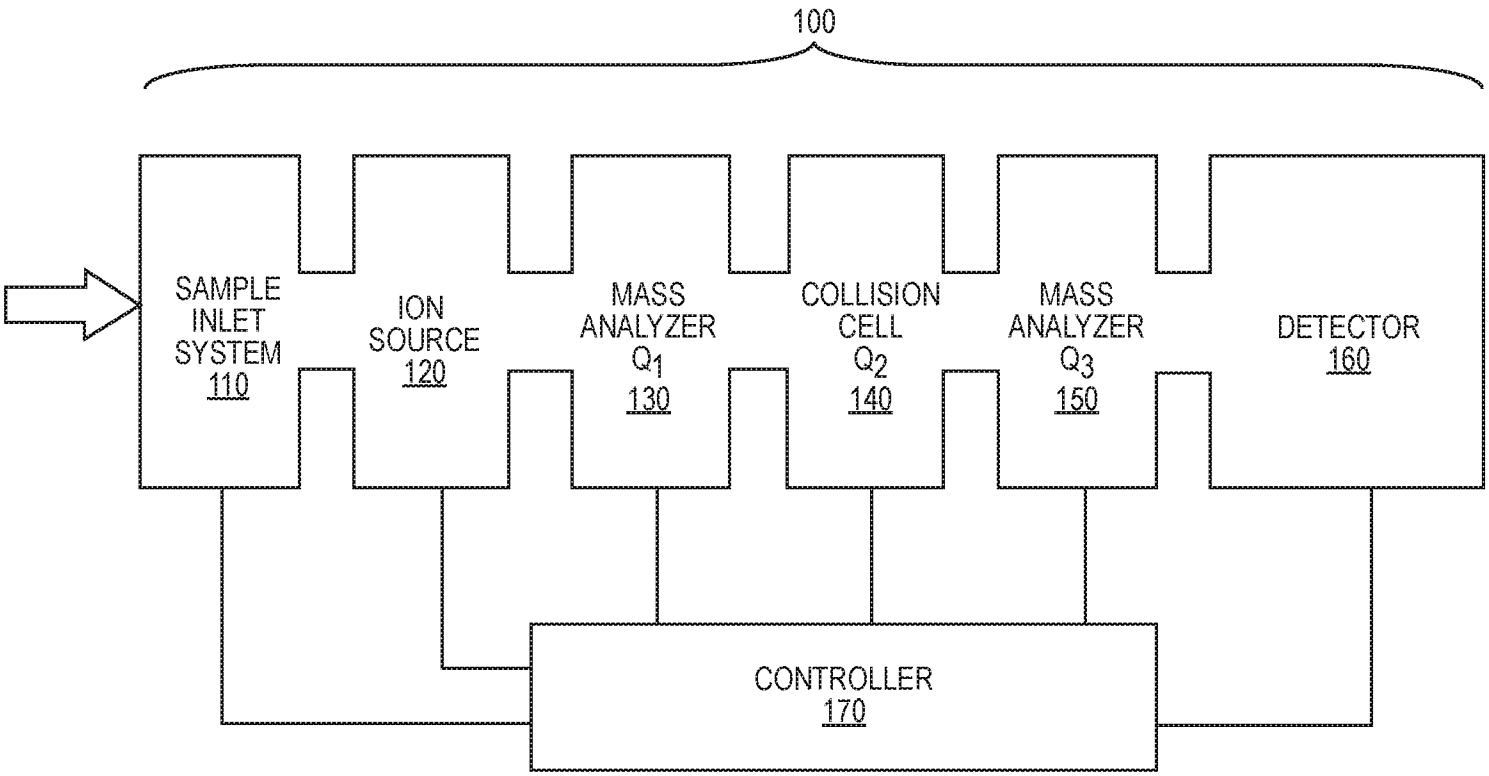
FIG. 1, in schematic diagram, illustrates an exemplary sample analysis system in accordance with aspects of various embodiments of the applicant's teachings.

With reference now to FIG. 1, an exemplary sample analysis system 100 in accordance with various aspects of the present teachings is depicted in schematic view. The depicted sample analysis system 100 comprises a sample inlet system 110, an ion source 120 for generating precursor ions from the sample, a first mass analyzer (Q1) 130, a collision cell (Q2) 140, a second mass analyzer (Q3) 150, and a detector (160). As shown in FIG. 1, the sample analysis system 100 can also include a controller 170 that can be operatively connected to various components of the sample analysis system 100 for controlling operation thereof. As described otherwise herein, the sample analysis system 100 can be operated under the control of the controller 170 in a variety of operational modes, depending on a particular type of mass spectrometry experiment to be conducted. For example, the sample analysis system 100 can operate in a mass spectrometry mode ("MS mode") to acquire a precursor ion spectrum or in a tandem mass spectrometry mode ("MS/MS mode") to acquire a product ion spectrum, as known in the art and modified in accordance with the present teachings. By way of example, the controller 170 can be configured so as to initially operate the system 100 to produce a survey scan of all precursor ions generated by the ion source 120 and detected by the detector 160 (e.g., at an elution time from an LC operating as the sample inlet system 110). The detected ion data can be stored in memory and analyzed by a computer or computer software associated with the controller 170 to select in real-time precursor ions identified in the survey scan for further processing, for example, within the collision cell 140 and/or the second mass analyzer 150 so as to produce a first generation product ion spectrum for the selected precursor ion.

It will be appreciated by a person skilled in the art that the sample inlet system 110 and the ion source 120 coupled thereto can be any suitable sample inlet system and ion source known in the art or hereafter developed and modified in accordance with the present teachings. For example, the sample inlet system 110 can perform sample preparation/sample processing using a liquid chromatography (LC) column and/or serve as a reservoir for containing a sample to be delivered to the ion source 120 (e.g., via one or more pumps, conduits, valves, etc.). As will be understood, liquid chromatography may be used, for example, to separate species dissolved in a solvent from other substances in the sample, and release or emit such species for ionization and/or MS analysis. As a result of the different timings for the chemical interactions that take place during the LC phase, reaction products (which include the ions or analytes of interest) can be released over time, and the release times for specific analytes can be estimated, based on the expected chemical interactions in the LC column.

Generally, the ion source 120 is configured to generate precursor ions, which can be received by downstream mass analyzer for further processing, and which can be fragmented to produce product ions. It will also be appreciated in light of the present teachings that the ion source 120 can be any ion source 120 known in the art or hereafter developed and modified in accordance with the present teachings. By way of non-limiting example, the inlet system 110 and the ion source 120 can comprise an electrospray source with the ability to generate ions from a sample analyte dissolved in solution. Other exemplary arrangements of the sample inlet system 110 and the ion source 120 include atmospheric pressure chemical ionization (APCI), atmospheric pressure photo-ionization (APPI), direct analysis in real time (DART), desorption electrospray (DESI), atmospheric pressure matrix-assisted laser desorption ionization (AP MALDI), multimode ionization sources, or configurations with multiple inlet systems and/or sources.

Though the inlet system 110 and the ion source 120 are depicted as separate elements, it will be appreciated that the inlet system 110 and the ion source 120 can be integrated. In some aspects, preferred sample inlet systems 110 and ion sources 120 can be those which generate ions from the sample over time, to enable recursive mass analysis by the sample analysis system 100 in accordance with the present teachings. Though not shown, it should be appreciated that one or more ion transmission guides and/or ion optical elements, such as a focusing lens, a multipole ion guide, ring guide, an ion mass filter (e.g., a quadrupole mass filter), an ion mobility filter (e.g., a differential mobility spectrometer), or an ion trapping device can additionally be disposed between the ion source 120 and the first mass analyzer (Q1) 130.

The number and type of mass analyzers (e.g., mass analyzers 130, 150 and collision cells 140) can vary in accordance with the present teachings. In the exemplary system 100 of FIG. 1, however, the system 100 includes a pair of mass analyzers 130, 150 and a collision cell 140 positioned therebetween. Though two mass analyzers 130, 150 are illustrated in FIG. 1, it will be appreciated that the sample analysis system 100 can comprise more or fewer mass analyzers for other implementations. For example, it is contemplated that the sample analysis system 100 can be implemented in a tandem-in-time fashion, in which case the sample analysis system can comprise a single mass analyzer. Depending on a particular operational mode of the sample analysis system 100, the first mass analyzer 130 can be operated to select ions based on a mass-to-charge ratio or to transmit all or substantially all ions.

In the exemplary depicted sample analysis system 100, collision cell 140 is positioned downstream with respect to the first mass analyzer 130 to receive ions transmitted therefrom. Depending on a particular operational mode of the sample analysis system 100, the collision cell 140 can be operated to induce fragmentation of ions to produce product ions or to transmit all or substantially all ions. The second mass analyzer 150 is positioned downstream relative to collision cell 140 and is configured to receive ions (e.g., precursor or product ions) transmitted therefrom. In some aspects, the second mass analyzer can be operated to separate the ions based on mass-to-charge ratio. It should be appreciated in light of the present teachings that the first and second mass analyzers 130, 150 can have a variety of configurations, including by way of non-limiting example, quadrupole mass analyzers, time-of-flight mass analyzers, ion trap mass analyzers, and the like. Collision cell 140 can likewise have a variety of configurations, such as using an inert gas to induce fragmentation of ions based on CID.

As shown in FIG. 1, the sample analysis system 100 can also comprise a detector 160, which is positioned downstream relative to the second mass analyzer 150 to receive ions therefrom. In various aspects, detector 160 can be operated to detect the abundance of precursor or product ions so as to acquire one or more sets of spectra. For example, in one exemplary operational mode, detector 160 can be configured to detect the abundance of precursor ions to acquire a precursor ion spectrum, or alternatively, the abundance of product ions to acquire a product ion spectrum. It will be appreciated that detector 160 can have a variety of configurations, including any detectors suitable for use with the methods and systems described herein, whether known or hereafter developed and modified in accordance with the present teachings. By way of non-limiting example, the detector can be an electron multiplier, a scintillation counter, and the like.

As noted above, the exemplary sample analysis system 100 also includes a controller 170 operatively connected to various components of the sample analysis system 100 for controlling operation thereof. In particular, controller 170 can direct the sample analysis system 100 to operate in a particular operational mode depending on a particular type of mass spectrometry experiment to be conducted in accordance with the present teachings. Moreover, in conjunction with specifying a particular operational mode, the controller 170 can specify or actively change a variety of parameters for the sample analysis system 100, such as parameters for operating the sample inlet system 110, the ion source 120, the first and second mass analyzers 130, 150, the collision cell 140, and the detector 160. In various aspects of the present teachings, the controller 170 can specify ionization settings, ranges of mass-to-charge ratios, spectrum acquisition rates, signal-to-noise ratios, mass resolution, fragmentation settings, detector gain, all by way of non-limiting example. As will be appreciated by a person skilled in the art, the controller 170 can be connected to the sample analysis system 100 using any convenient wired or wireless transmission channel.

In various aspects of the present teachings, the controller 170 can operate as a real-time engine to perform real-time analysis of acquired spectra and to direct the sample analysis system 100 to operate in a particular operational mode based on results of the real-time analysis. By way of example, the controller 170 can enable automated, mass spectrometric analysis by specifying or actively changing a type of mass spectrometry experiment to be conducted based on the results of the real-time analysis. In particular, the results of the real-time analysis can be the basis for initiating or refining additional analysis or for initiating or refining acquisition of additional mass spectrometry data. In such a manner, the sample analysis system 100 can operate in a mass spectrometry mode ("MS mode") to acquire a precursor ion spectrum from which precursor ions can be selected for further processing (e.g., in a "MS/MS mode") so as to generate a product ion spectrum from precursor ions corresponding to selected peaks of the precursor ion spectrum. By way of example, the controller 170 can be configured so as to initially operate the system 100 to acquire a precursor ion spectrum of a particular eluting portion of the sample. The detected ion data can then be stored in memory and analyzed by a computer or computer software associated with the controller 170 to perform a real-time analysis of the precursor ion spectrum to identify candidate peaks corresponding to specific precursor ions (e.g., having a specified m/z), from which one or more of the precursor ions can be selected for further processing, e.g., for fragmentation within the collision cell 140 and/or mass analysis within the second mass analyzer 150 so as to produce a first generation product ion spectrum of the selected precursor ion. In particular, the controller 170 can direct the mass spectrometer to acquire a set of product ion spectra for the selected peaks. By performing the analysis of the precursor ion spectrum in real-time, product ion spectra can be acquired from the same eluting portion of the sample from which the precursor ion spectrum was acquired, thus allowing an analysis of that eluting portion in accordance with the present teachings.

It will be appreciated that the controller 170 can be connected to the components of the sample analysis system using any convenient wired or wireless transmission channel. Moreover, the controller 170 can be implemented in a variety of ways, such as using computer code, hardwired circuitry, or a combination of computer code and hardwired circuitry. For example, it is contemplated that the controller 170 can comprise or can operate in conjunction with a computing device, such as a personal computer, a server computer, a web appliance, a personal digital assistant product, or the like. Moreover, in some aspects, the controller 170 can provide a user interface to allow a user to specify a variety of processing options.

In one aspect, the controller 170 of FIG. 1 can comprise a computer storage product having computer-readable medium comprising computer code or executable instructions thereon for performing a set of computer-implemented operations as described herein (e.g., as described below with reference to FIG. 2). Examples of computer-readable media comprise: magnetic media such as hard disks, floppy disks, and magnetic tape; optical media such as Compact Disc-Read Only Memories ("CD-ROMs") and holographic devices; magneto-optical media such as floptical disks; and hardware devices that are specially configured to store and execute computer code, such as Application-Specific Integrated Circuits ("ASICs"), Programmable Logic Devices ("PLDs"), and Read Only Memory ("ROM") and Random Access Memory ("RAM") devices. Examples of computer code comprise machine code, such as produced by a compiler, and files comprising higher-level code that are executed by a computer using an interpreter. For example, an embodiment of the invention can be implemented using Java, C++, or another programming language. Moreover, an embodiment of the invention can be downloaded as a computer program product, which can be transferred from a remote computer to a requesting computer by way of data signals embodied in a carrier wave or other propagation medium via a transmission channel. Accordingly, as used herein, a carrier wave can be regarded as a computer-readable medium. Another embodiment of the invention can be implemented in hardwired circuitry in place of, or in combination with, computer code.

Figure 2:
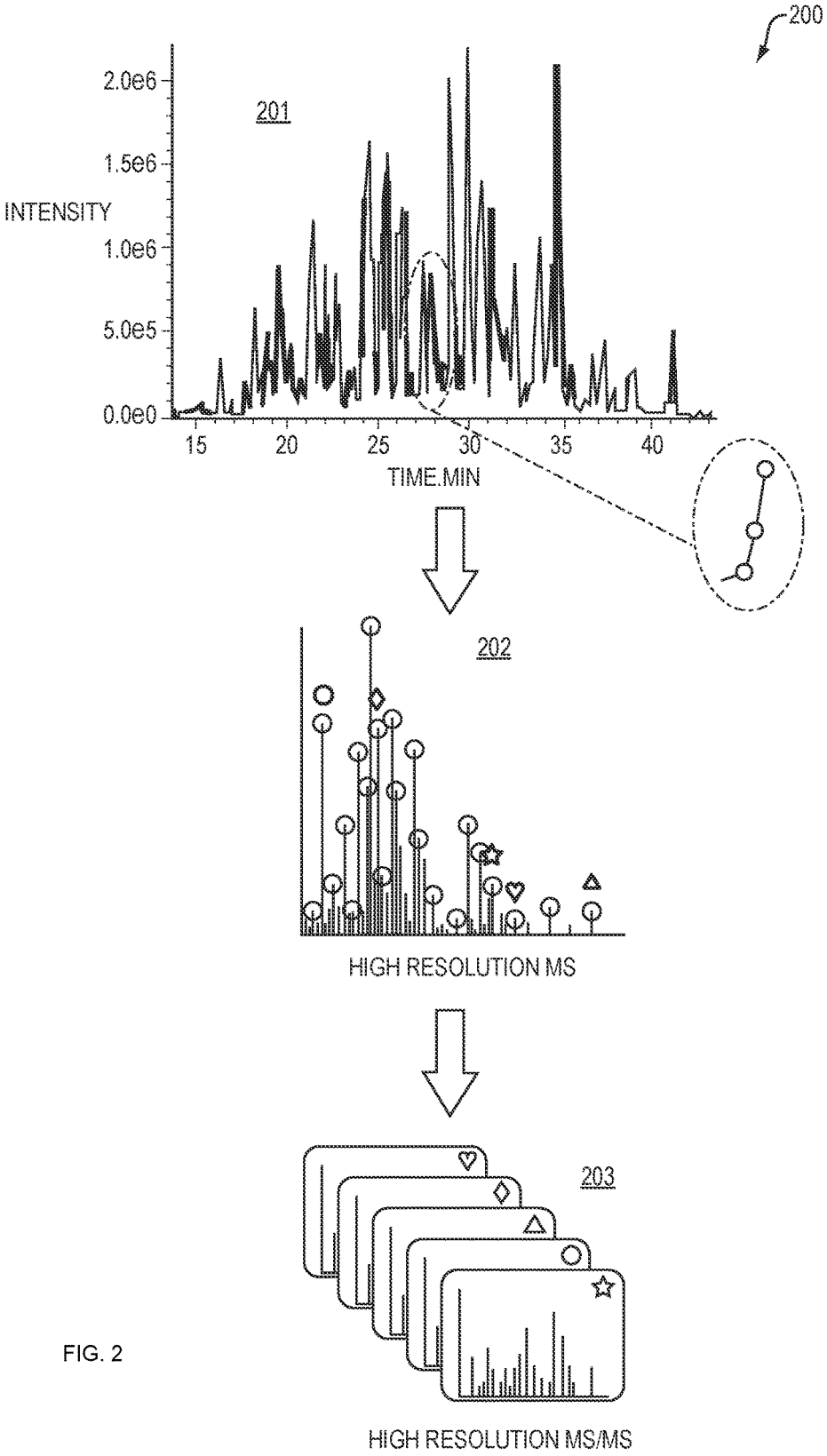
FIG. 2 schematically depicts an exemplary method for selection of precursor ions for further processing in accordance with aspects of various embodiments of the applicant's teachings.

With reference now to FIG. 2, an exemplary method 200 for processing a sample (e.g., a biological sample) that can be performed by the sample analysis system 100 of FIG. 1 is schematically depicted. In particular, FIG. 2 illustrates an exemplary process for selecting ions for subsequent ion fragmentation. The exemplary method begins at step 201, in which an ion chromatogram is generated during a sample run through an LC column. The inset at 28 minutes, for example, depicts a rapid increase in an observed ion intensity (it will be appreciated that this elution time can be selected randomly or can be empirically determined for a particular analyte of interest). At this elution time, the controller 170 can operate the sample analysis system 100 to acquire a survey scan of all precursor ions present in the LC eluent, as schematically depicted in step 202. By way of example, a high resolution TOF MS spectra can be acquired. Subsequently, in step 203, the controller 170 can be configured to select precursor ions corresponding to particular candidate peaks from the survey scan in accordance with the present teachings. For example, as depicted schematically in FIG. 2, the controller 170 may first select the candidate peak identified by a star in the precursor ion spectrum. As noted above, whereas current automated IDA or DDA protocols would generally select precursor ions corresponding to the most intense peaks in the survey scan in an attempt to maximize the number of high quality, identifiable MS/MS spectra, various aspects of the present teachings provide that the controller 170 can select stochastically (e.g., at random) any of the candidate peaks identified in the survey scan schematically depicted in step 202.

As will be appreciated by a person skilled in the art in accordance with the present teachings, the precursor ions corresponding to the m/z of the selected peak can then be transmitted from the first mass analyzer (Q1) 130 to the collision cell (Q2) 140 for fragmentation (e.g., CID) into product ions, which can then be transmitted into the second mass analyzer (Q3) 150 for mass filtering before being transmitted to the detector 160, which can generate data indicative of the product ion spectrum, as indicated by the star in step 203. Subsequently, the controller 170 can be configured to select another of the candidate peaks depicted in the survey scan of step 202. For example, in the exemplary method of FIG. 2, the relatively low m/z, high intensity peak represented by the circle can be stochastically selected and transmitted downstream so as to generate the product ion spectrum in step 203. The method 200 can continue with the controller 170 repeating the selection of precursor ions corresponding to peaks of the survey scan (i.e., in the order of star, circle, triangle diamond, heart) without regard to the relative intensities of the selected precursor ions (e.g., candidate peak corresponding to the star in the product ion scan are selected and processed prior to the candidate peak corresponding to the circle, despite the circle peak's higher intensity in the survey scan).

That is, rather than analyzing precursor ions in order of the most-intense ion to the least-intense ion in the survey scan, the controller 170 can operate the sample analysis system 100 such that candidate peaks are analyzed without regard to their relative intensity to one another. Relative to conventional IDA or DDA, such an approach removes the bias toward the most intense species in the automated processing of a sample, and thus in some aspects, increases the range of precursor ions subject to further processing. For example, while an abundant protein at a given elution time may generate several precursor ions that display high intensity peaks in the survey scan, analysis of these species can consume instrument time that could instead be devoted to inspecting ions of lower intensity that belong to different, overlooked analytes within the co-eluted sample.

It will be appreciated that candidate peaks can be identified in accordance with the present teachings in a variety of manners, with one or more filters being applied to identify these candidate peaks. For example, in some aspects, candidate peaks can be identified from the precursor ion spectrum based on a threshold intensity of the peaks in the precursor ion spectrum. For example, though precursor ions corresponding to selected peaks may be selected without regard to the relative intensity of the peak in the survey scan relative to the precursor ions that are selected for further processing directly before or after, the candidate peak must in some aspects reach some threshold level of intensity (or signal-to-noise ratio).

Alternatively or additionally, candidate peaks can be identified from the precursor ion spectrum based on the precursor ions exhibiting a selected charge state. For example, the controller 170 can be configured to identify as candidates for selection those peaks corresponding to precursor ions exhibiting a selected charge state, which can be set by default or input by the user, for example. In such a manner, candidate peaks corresponding to multiply charged species, which tend to be those analytes having proteomic and/or biologic activity can be preferentially selected. In accordance with some aspects, the selection of precursor ions corresponding to selected peaks can additionally or alternatively be weighted so as to provide for the preferential weighting of ions on an inclusion list. For example, the inclusion list can be a user-defined list that comprises a m/z range of interest or one or more selected MRM transitions. Though the selection of ions for further processing can be performed stochastically, the selection can also be weighted based on empirical data if a priori knowledge of a desired candidate(s). For example, in selecting ions for further processing, the method can assign peaks corresponding to selected m/z ratios (e.g., as listed in an inclusion list) a higher weighting or priority relative to candidate peaks identified in the survey scan corresponding to m/z ratios absent from the inclusion list. In accordance with various aspects of the present teachings, the inclusion list can include for each peptide of interest at least one of a predicted retention time for the peptide, at least one protein of interest to which the peptide belongs, and a sequence of the peptide. The mass of the precursor ions corresponding to the peaks of the survey scan can thus be compared to a mass of the peptides in the inclusion list so as to assign a higher priority or weight to its selection.

Additionally or alternatively, the controller 170 can be configured to apply an exclusion window such that once a candidate peak has been selected, the controller 170 will not select precursor ions corresponding to that same peak for a specified amount of time, which can be set by default of input by the user, for example.

Though the application of a stochastic method to the selection of ions for further processing is described above with reference to the selection of the precursor ions, it will be appreciated in light of the present teachings that the methods and systems described herein can also be applied to downstream processing of ions (e.g., in product ion analysis in MS' techniques). For example, with the product ion spectrum generated in accordance with the methods described herein or using conventional IDA or DDA, the selection of product ions for further processing can be done stochastically so as to generate a second generation ion product spectrum without regard to the relative intensities of ions corresponding to the peaks of the first generation product ion spectra.

In accordance with various aspects of the present teachings, computer readable media configured to cause a mass spectrometer having a computer controller to perform the methods described herein can also be provided.

In accordance with various aspects of the present teachings, a mass spectrometry system is provided that comprises a mass spectrometer and a controller operatively coupled to the mass spectrometer for controlling operation thereof. By way of example, the controller can include a processor configured to control the mass spectrometer so as to: (a) perform a mass spectrometry survey scan on ions from a sample to acquire a precursor ion spectrum, the precursor ion spectrum exhibiting a plurality of peaks, each of which corresponds to a plurality of ions having an indicated m/z ratio; (b) select precursor ions corresponding to a first peak of the survey scan for further processing; (c) perform mass spectrometry on the precursor ions corresponding to the first peak so as to acquire a first product ion spectrum; (d) select precursor ions corresponding to a second peak of the survey scan for further processing; and thereafter (e) perform mass spectrometry on said precursor ions corresponding to the second peak so as to acquire a second product ion spectrum, wherein the second peak of the survey scan exhibits a higher intensity relative to the first peak in the survey scan.

In some aspects, the controller can be configured to provide an inclusion list in response to data supplied by a user of the system. By way of example, the controller can be configured to select for further processing precursor ions corresponding to candidate peaks representing m/z ratios identified in the inclusion list. Though precursor ions selected for further processing can be determined stochastically, the controller can be configured to assign priority or weight the candidate peaks based in part on being on the inclusion list.

Aspects of the applicant's teachings may be further understood in light of the following examples, which should not be construed as limiting the scope of the applicant's teachings in any way. Additionally, teachings from each example can be combined without departing from the scope of the invention.

EXAMPLES

Figure 3:
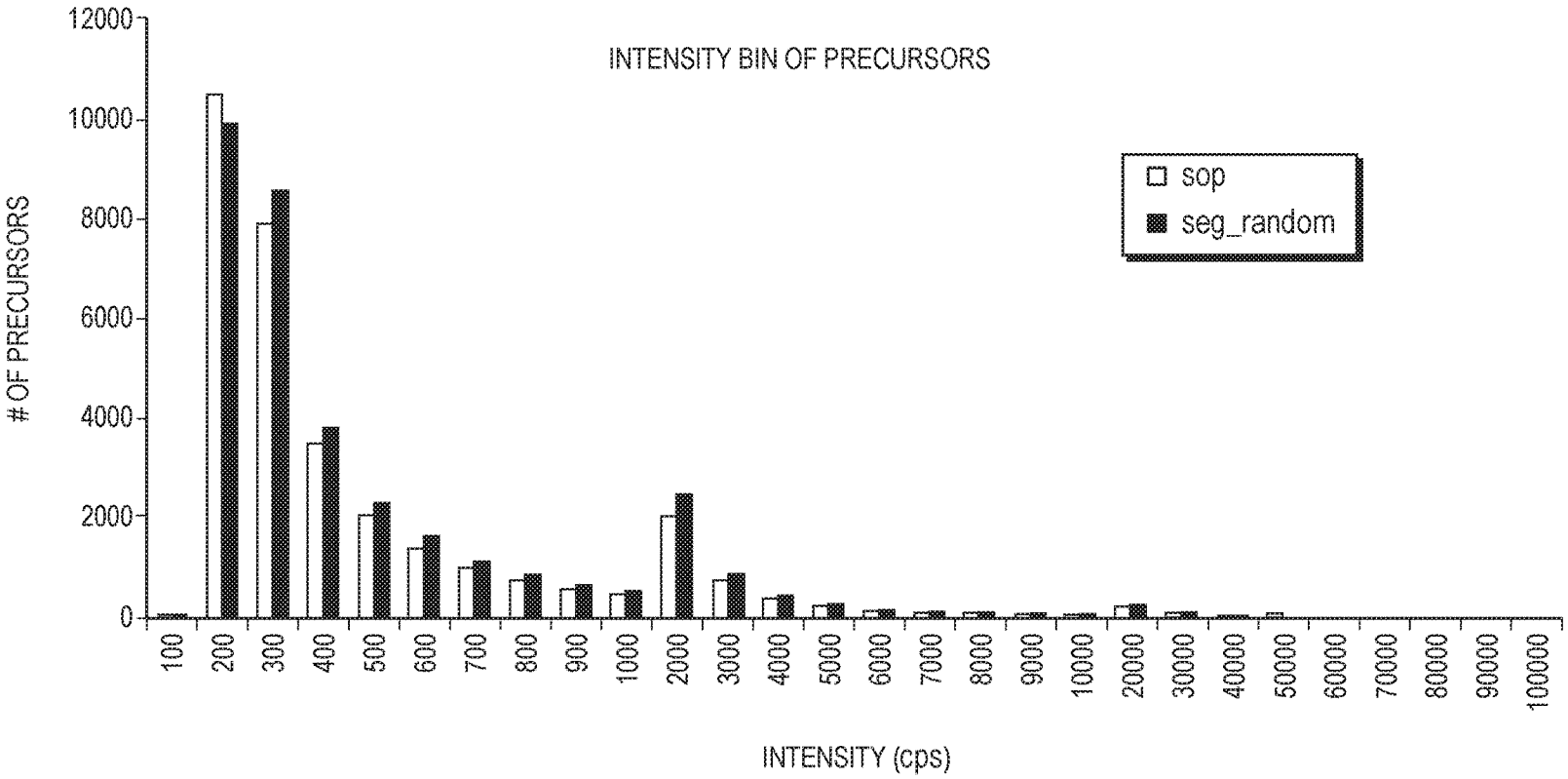
FIG. 3 depicts exemplary data demonstrating the number of precursor ions detected in a survey scan operated in accordance with conventional IDA and an exemplary method as described with reference to FIG. 2.

With reference now to FIG. 3, exemplary data is presented depicting the number of precursor ions detected in a survey scan operated in parallel runs of a sample in accordance with conventional IDA (left column) and an exemplary method in accordance with the present teachings (right column) at a number of intensity points. First, this plot demonstrates that the number of precursor ions in each intensity bin as detected in the survey scans are substantially identical, which can be important in analyzing the results depicted in FIG. 4. Second, this plot additionally demonstrates that a significant number of detected precursor ions in a complex sample (i.e., an E-Coli standard from Waters Corp.) exhibited an intensity below 1000 cps, which is a relatively weak signal. In light of this data, it will be appreciated that the conventional focus on only the most intense precursor ions in selecting ions for further processing can lead to a large number of relatively weak-intensity precursor ions being overlooked. Moreover, because of the exclusion filters that are generally applied in conventional IDA (e.g., to exclude low-intensity ions), conventional IDA can potentially result in the loss of sensitivity and/or a decrease in the mass range of precursor candidates.

In this exemplary experiment, both data sets were acquired where up to 20 candidates were selected per survey scan and run in MS/MS mode with Collision energy spread by +/−5 eV around an estimated based on the precursor mass and charge. The MS/MS spectra were acquired with 50 ms accumulation times.

Figure 4:
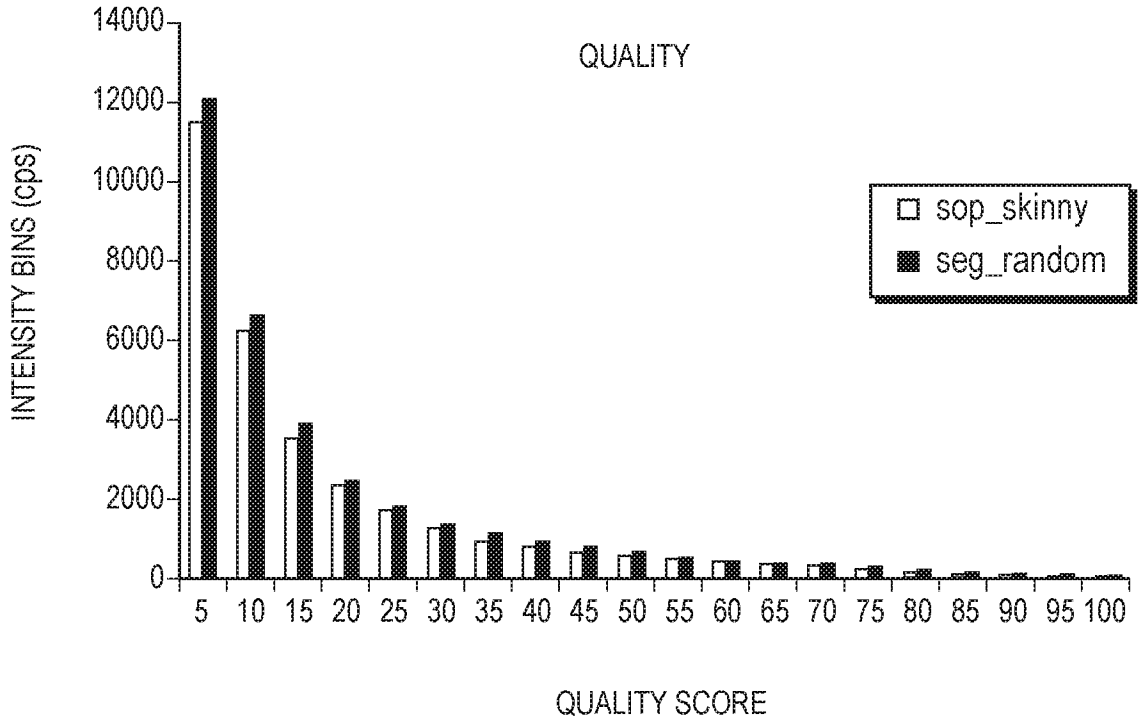
FIG. 4 depicts exemplary data indicating the quality of the product ion spectra obtained from multiple precursor ions selected from the survey scan of FIG. 3 in accordance with conventional IDS and an exemplary method as described with reference to FIG. 2.

With reference now to FIG. 4, this plot indicates the relative frequency (y-axis) of product spectra exhibiting quality (x-axis) as determined based on the percentage of peaks above certain intensity/noise ratios in parallel runs of a sample in accordance with conventional IDA (left column) and an exemplary method in accordance with the present teachings (right column). This shows the frequency of different MS/MS quality factors for different MS/MS events. Quality is defined as the amount of (signal>than the noise)/total signal.

In sum, the data demonstrates that methods in accordance with the present teachings can identify the same number of peptides, while providing ease of use (e.g., no need to set up filters) and increasing the possible mass range of selected precursor ions relative to conventional IDA.

Those skilled in the art will know or be able to ascertain using no more than routine experimentation, many equivalents to the embodiments and practices described herein.

Accordingly, it will be understood that the invention is not to be limited to the embodiments disclosed herein, but is to be understood from the following claims, which are to be interpreted as broadly as allowed under the law.

The section headings used herein are for organizational purposes only and are not to be construed as limiting. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

The invention claimed is:

1. A method of analyzing a sample, comprising:

(a) performing a mass spectrometry survey scan on ions from a sample to acquire a precursor ion spectrum, the precursor ion spectrum exhibiting a plurality of peaks, each of which corresponds to a plurality of ions having an indicated m/z ratio;

(b) selecting a first peak of the survey scan corresponding to a first plurality of compound ions for further processing;

(c) performing mass spectrometry on said first plurality of compound ions corresponding to the first peak so as to acquire a first product ion spectrum;

(d) selecting a second peak of the survey scan corresponding to a second plurality of compound ions for further processing; and (e) performing mass spectrometry on said second plurality of compound ions corresponding to the second peak so as to acquire a second product ion spectrum, wherein at least one of the first and the second peak of the survey scan are selected randomly.

2. The method of claim 1, wherein the step of selecting the second peak is not based on relative intensities of the first peak and the second peak in the survey scan.

3. The method of claim 1, further comprising repeating steps (d)-(e) N times so as to select N peaks corresponding to a plurality of compound ions for further processing and performing mass spectrometry on said selected compound ions to acquire N product ion spectra, wherein the N peaks are selected randomly.

4. The method of claim 3, wherein the random selection is not based on relative intensity of the first peak relative to the second peak.

5. The method of claim 1, wherein the first and second compound ions are selected stochastically from a plurality of candidate peaks of the compound ion spectrum.

6. The method of claim 5, wherein the candidate peaks are identified from the compound ion spectrum based on a threshold intensity in the compound ion spectrum.

7. The method of claim 5, wherein the candidate peaks are identified from the compound ion spectrum based on a selected charge state.

8. The method of claim 5, wherein the candidate peaks are identified from the compound ion spectrum based on being outside an exclusion window.

9. The method of claim 5, wherein the candidate peaks correspond to one or more species of interest identified in an inclusion list.

10. The method of claim 9, wherein the inclusion list comprises a m/z range of interest.

11. The method of claim 9, wherein the inclusion list comprises one or more selected MRM transitions.

12. The method of claim 9, wherein the candidate peaks corresponding to m/z ratios on the inclusion list are assigned a higher priority relative to candidate peaks corresponding to m/z ratios absent from the inclusion list.

13. The method of claim 1, wherein selecting compound ions corresponding to the first and second peaks of the survey scan for further processing comprises:

providing an inclusion list of peptides of interest, the inclusion list comprising for each peptide of interest at least one of the following: (1) a predicted retention time for the peptide, (2) at least one protein of interest to which the peptide belongs, and (3) a sequence of the peptide; and comparing a mass of the compound ions corresponding to the peaks of the survey scan to a mass of the peptides in the inclusion list.

14. The method of claim 1, further comprising:

performing mass spectrometry on product ions corresponding to one or more peaks of the first product ion spectrum.

15. The method of claim 1, further comprising:

(c)(1) selecting a first peak of the first product ion spectrum corresponding to a first plurality of product ions for further processing;

(c)(2) performing mass spectrometry on said first plurality of product ions corresponding to the first peak of the first product ion spectrum so as to acquire a first second-generation ion product spectrum;

(c)(3) selecting a second peak of the first product ion spectrum corresponding to a second plurality of product ions for further processing; and thereafter (c)(4) performing mass spectrometry on said second plurality of product ions corresponding to the second peak of the first product ion spectrum so as to acquire a second second-generation ion product spectrum, wherein at least one of the first and the second peak of the survey scan are selected randomly.

16. Computer readable media configured to cause a mass spectrometer having a computer controller to perform the method of claim 1.

17. A mass spectrometry system comprising:

a mass spectrometer; and a controller connected to the mass spectrometer, the controller including a processor configured to execute the method of claim 1.

18. The system of claim 17, wherein the controller is configured to provide an inclusion list in response to data supplied by a user of the system.

19. The system of claim 18, wherein the controller is configured to select for further processing compound ions corresponding to candidate peaks representing m/z ratios identified in the inclusion list.

20. The system of claim 18, wherein the controller is configured to rank the candidate peaks based in part on being on the inclusion list.

* * * * *